US006896168B1

(12) United States Patent
Logan

(10) Patent No.: US 6,896,168 B1
(45) Date of Patent: May 24, 2005

(54) FRAMING POINT DRIVER SYSTEM

(76) Inventor: Curt Logan, 1100 Brown St., Wauconda, IL (US) 60084

( * ) Notice: Subject to any disclaimer, the term of this patent is extended or adjusted under 35 U.S.C. 154(b) by 0 days.

(21) Appl. No.: 10/453,680

(22) Filed: Jun. 2, 2003

(51) Int. Cl.[7] ..... B25C 7/00
(52) U.S. Cl. ..... 227/147; 227/151; 227/142; 227/143; 227/119; 227/120; 227/153; 227/156
(58) Field of Search ..... 227/151, 142, 227/143, 147, 120, 119, 153, 156

(56) References Cited

U.S. PATENT DOCUMENTS

| | | | | |
|---|---|---|---|---|
| 956,128 | A | 4/1910 | Mimmack | |
| 4,763,825 | A | 8/1988 | Albin | 227/142 |
| 5,096,170 | A | 3/1992 | Albin | 269/6 |
| 5,605,270 | A | 2/1997 | Dunn | 227/140 |
| 5,816,467 | A | 10/1998 | Dunn | 227/3 |
| 6,481,613 | B1 | 11/2002 | Tebo | 227/147 |

OTHER PUBLICATIONS www.frammingsupplies.com, F40D-1 Fitting Tool, 1998, 2 pages.*
Fletcher FrameMate Framing Tool May 13, 2003.

* cited by examiner

*Primary Examiner*—Louis K. Huynh
*Assistant Examiner*—Michelle Lopez
(74) *Attorney, Agent, or Firm*—Michael S. Neustel

(57) ABSTRACT

A framing point driver system for efficiently driving various framing points into a picture frame. The framing point driver system includes a lever unit, a turret member with a plurality of receiver apertures rotatably attached to the lever unit, a shaft member extending from the lever unit, and an engaging arm lockably positioned about the shaft member. The user rotates the turret member so that the desired size receiver aperture is facing toward the engaging arm. A framing point is inserted into the selected receiver aperture for insertion into the picture frame.

20 Claims, 8 Drawing Sheets

FRAMING POINT DRIVER SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to framing point tools and more specifically it relates to a framing point driver system for efficiently driving various framing points into a picture frame.

2. Description of the Related Art

Framing point drivers have been in use for years. One type of framing point driver is similar to a staple gun with a reloadable magazine of framing points. Instead of the framing points exiting a lower end of the framing point drive, the framing points exit the lower front so as to retain the glass, picture and backing material securely within the frame molding rabbit.

Another type of framing point driver is another hand-powered unit that utilizes an arm member attached to a shaft wherein a lever structure is mechanically connected to the shaft. The user positions the framing pointer within the arm member and then manipulates the lever structure thereby causing the arm member to be pulled against the inside perimeter of the frame with the framing point fully inserted into the frame.

The main problem with conventional framing point drivers is that they are not capable of handling various sizes and styles of framing points. Another problem with conventional framing point drivers is that they are not efficient for the purposes of inserting a number of framing pointers.

Examples of patented devices which may be related to the present invention include U.S. Pat. No. 4,763,825 to Albin; U.S. Pat. No. 956,128 to Mimmack; U.S. Pat. No. 6,481,613 to Tebo; U.S. Pat. No. 5,816,467 to Dunn; U.S. Pat. No. 5,605,270 to Dunn; and U.S. Pat. No. 5,096,170 to Albin.

While these devices may be suitable for the particular purpose to which they address, they are not as suitable for efficiently driving various framing points into a picture frame. Conventional framing point drivers are not capable of driving more than one style of framing pointer.

In these respects, the framing point driver system according to the present invention substantially departs from the conventional concepts and designs of the prior art, and in so doing provides an apparatus primarily developed for the purpose of efficiently driving various framing points into a picture frame.

BRIEF SUMMARY OF THE INVENTION

In view of the foregoing disadvantages inherent in the known types of framing point drivers now present in the prior art, the present invention provides a new framing point driver system construction wherein the same can be utilized for efficiently driving various framing points into a picture frame.

The general purpose of the present invention, which will be described subsequently in greater detail, is to provide a new framing point driver system that has many of the advantages of the framing point drives mentioned heretofore and many novel features that result in a new framing point driver system which is not anticipated, rendered obvious, suggested, or even implied by any of the prior art framing point drivers, either alone or in any combination thereof.

To attain this, the present invention generally comprises a lever unit, a turret member with a plurality of receiver apertures rotatably attached to the lever unit, a shaft member extending from the lever unit, and an engaging arm lockably positioned about the shaft member. The user rotates the turret member so that the desired size receiver aperture is facing toward the engaging arm. A framing point is inserted into the selected receiver aperture for insertion into the picture frame.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a framing point driver system that will overcome the shortcomings of the prior art devices.

A second object is to provide a framing point driver system for efficiently driving various framing points into a picture frame.

Another object is to provide a framing point driver system that is capable of inserting various sizes and styles of framing points into a picture frame.

An additional object is to provide a framing point driver system that reduces bending of the framing points during insertion.

A further object is to provide a framing point driver system that positions the framing point into the frame at the proper angle.

Another object is to provide a framing point driver system that can be used to remove framing points.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
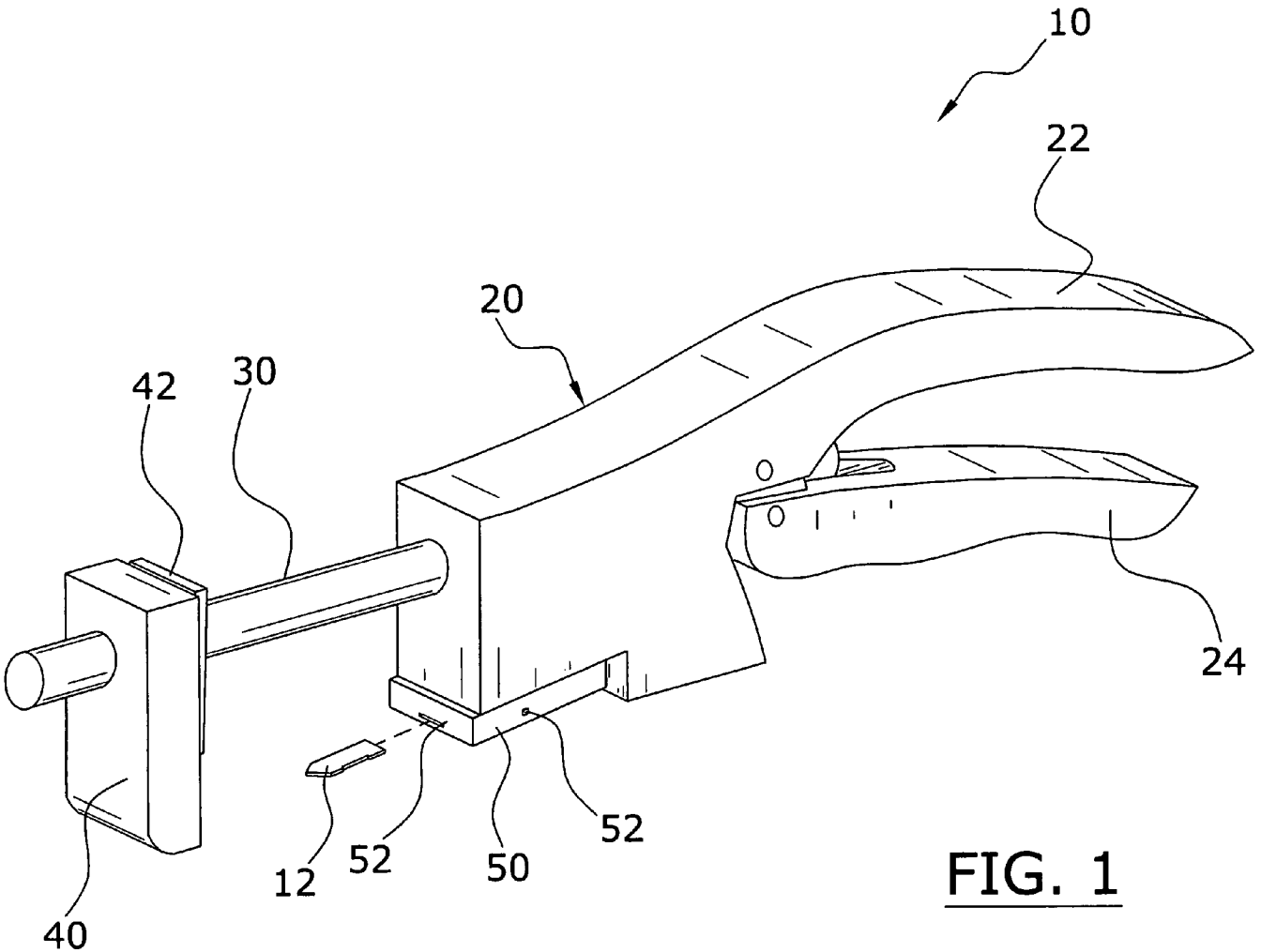
FIG. 1 is an upper perspective view of the present invention with a first style of framing point being inserted into the point turret.

Turning now descriptively to the drawings, in which similar reference characters denote similar elements throughout the several views, FIGS. 1 through 8 illustrate a framing point driver system 10, which comprises a lever unit 20, a turret member 50 with a plurality of receiver apertures 52 rotatably attached to the lever unit 20, a shaft member 30 extending from the lever unit 20, and an engaging arm 40 lockably positioned about the shaft member 30. The user rotates the turret member 50 so that the desired size receiver aperture is facing toward the engaging arm 40. A framing point 12 is inserted into the selected receiver aperture for insertion into the picture frame 14.

B. Lever Unit

The lever unit 20 is comprised of a structure capable of manipulating the shaft member 30 longitudinally. The lever unit 20 is able to draw the engaging arm 40 toward the lever unit 20 via a hand actuation movement or a motorized unit.

The lever unit 20 preferably has a handle member 22 with a lever member 24 for the user to squeeze. The handle member 22 extends forwardly and has a body with a lower cutout that receives the turret member 50. The lower cutout is sufficient in size to allow free rotation of the turret member 50 within.

As the user squeezes the lever member 24, the lever member 24 mechanically draws the shaft member 30 toward the lever unit 20. Various well-known mechanical structures may be utilized to mechanically connect the lever member 24 to the shaft member 30.

C. Shaft Member

Figure 5:
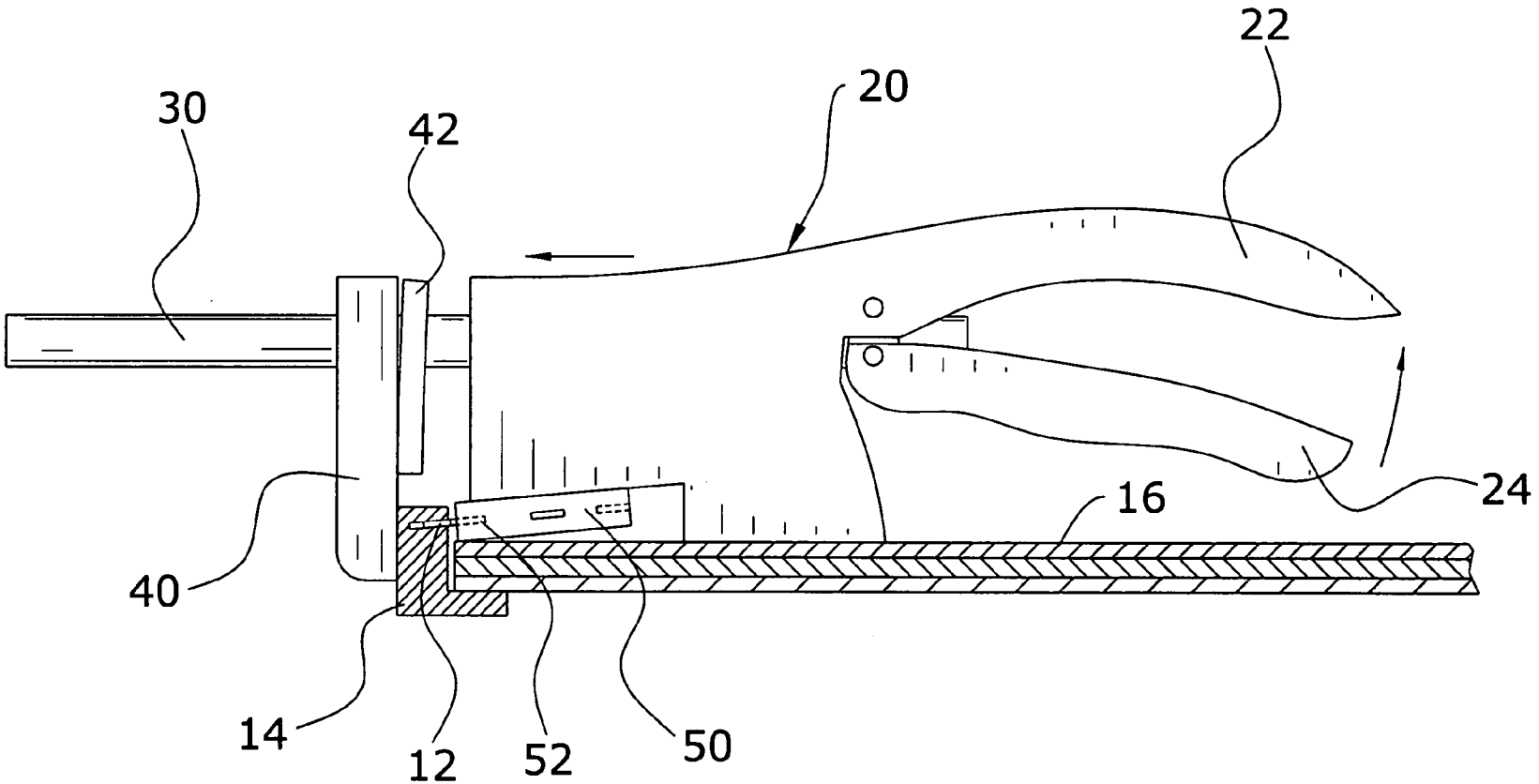
FIG. 5 is a side view of the present invention as initially positioned upon a picture frame with the framing point partially inserted into the frame.

The shaft member 30 movably extends in a longitudinal manner within the lever unit 20. The shaft member 30 preferably has a solid structure, however a tubular structure may also be utilized. The shaft member 30 has a longitudinal structure as best shown in FIG. 5 of the drawings. The shaft member 30 may have various lengths, sizes and shapes.

D. Engaging Arm

The engaging arm 40 is slidably and rotatably positioned about the shaft member 30. The engaging arm 40 extends transversely from the shaft member 30 as best shown in FIG. 5 of the drawings. The engaging arm 40 has a flat inner distal portion for engaging the outer edge of a picture frame 14 as shown in FIG. 5 of the drawings.

The engaging arm 40 includes a locking member 42 or other locking structure for selecting locking upon the shaft member 30. The locking member 42 is preferably comprised of a binding structure that binds against the shaft member 30 when a force is applied to the engaging arm 40.

E. Turret Member

The turret member 50 has a plurality of receiver apertures 52 for receiving various sizes and shapes of framing points 12. The turret member 50 preferably has a polygonal shape such as but not limited to rectangular, square or other structures. The turret member 50 preferably is comprised of a solid structure, however various other structures may be utilized to construct the turret member 50.

Figure 2:
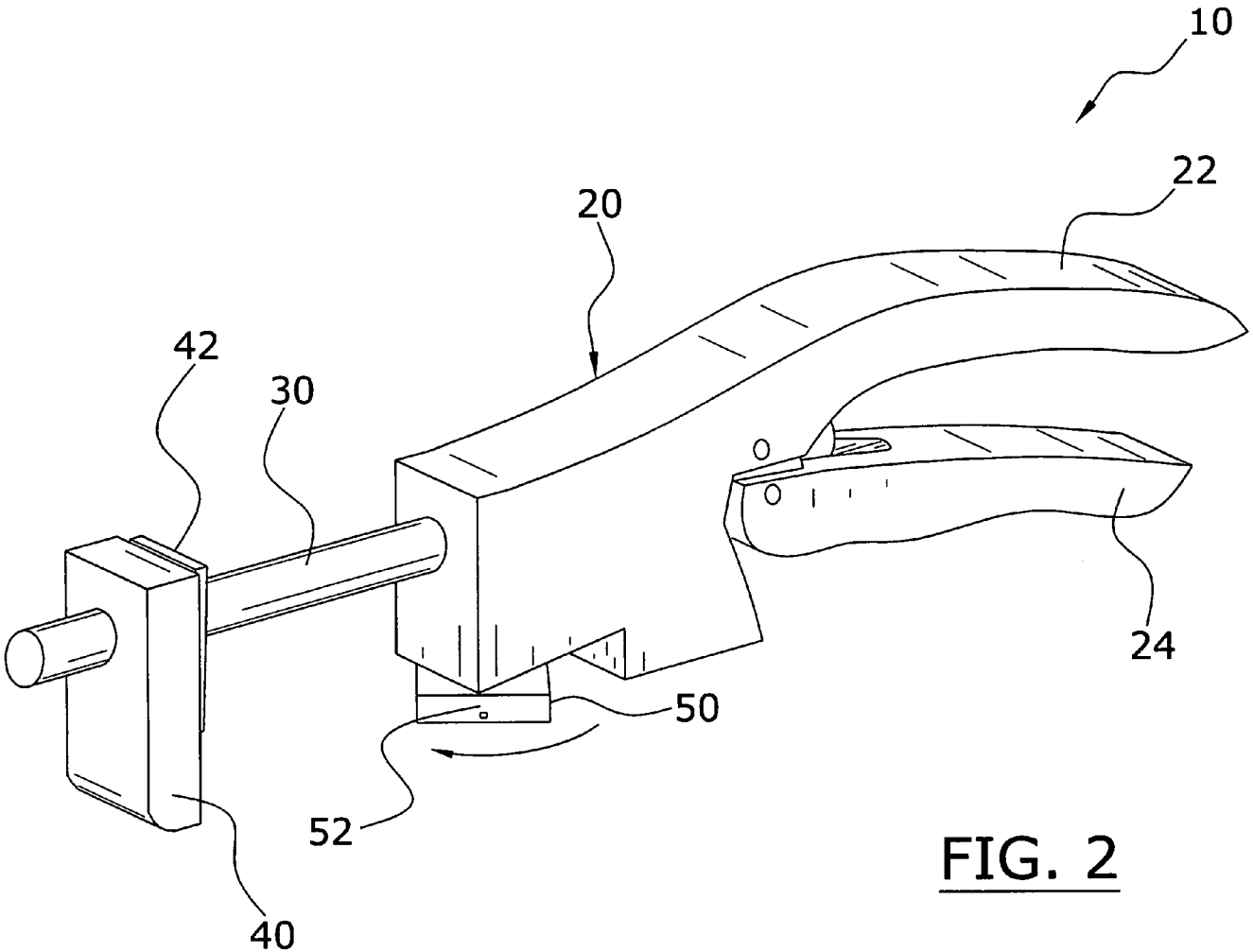
FIG. 2 is an upper perspective view of the present invention with the point turret being rotated to a second position.
Figure 4:
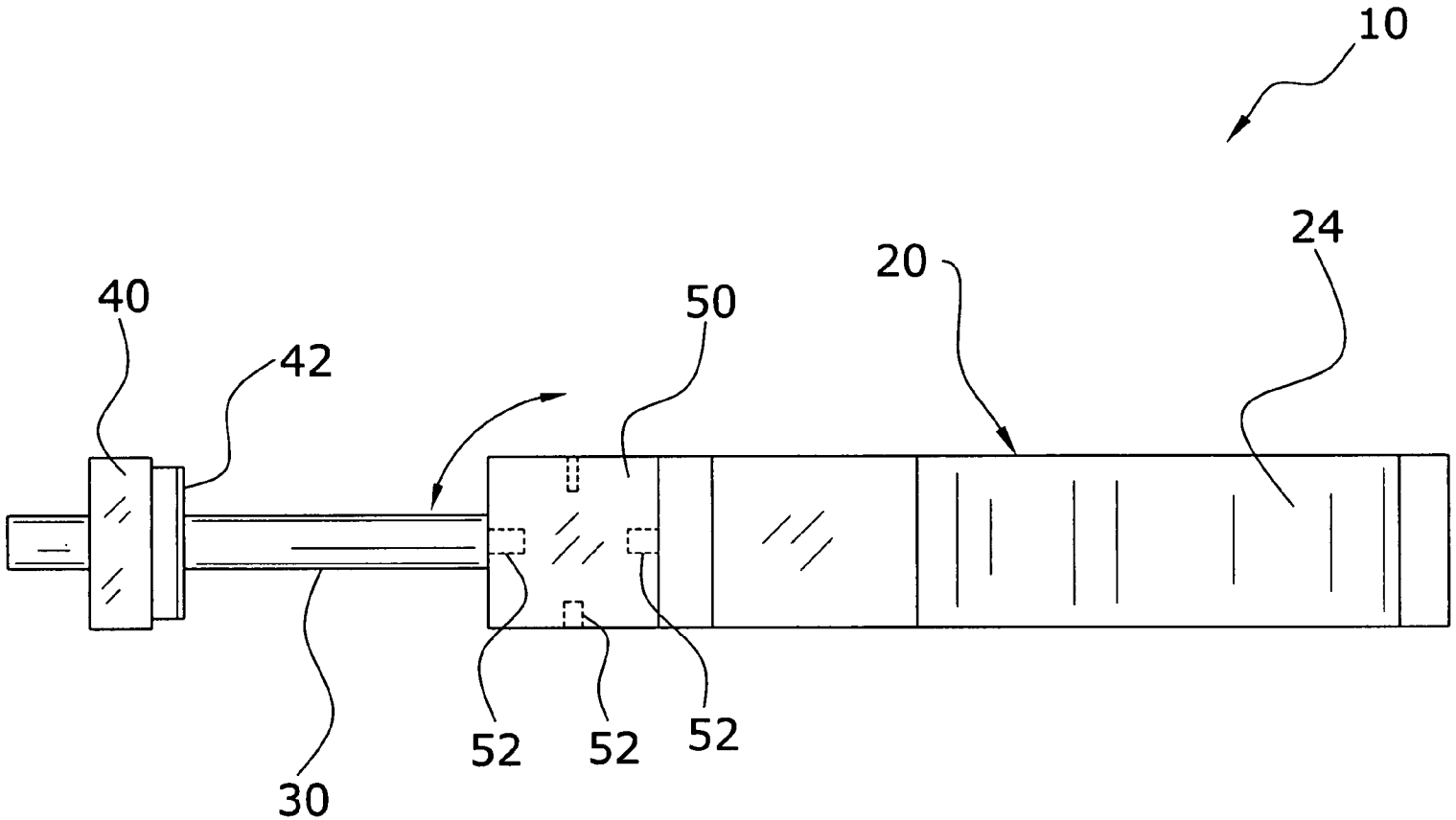
FIG. 4 is a bottom view of the present invention illustrating the plurality of different sized receiver apertures.

The turret member 50 is rotatably attached to the lever unit 20 as shown in FIGS. 2 and 4 of the drawings. The turret member 50 may be rotatably attached via various commonly utilized rotating mechanical structures such as but not limited to a bearing structure, a support shaft structure and the like. The turret member 50 preferably has a rotational plane transverse or at a slight angle with respect to the engaging arm 40 and substantially parallel to the shaft member 30.

Figure 6:
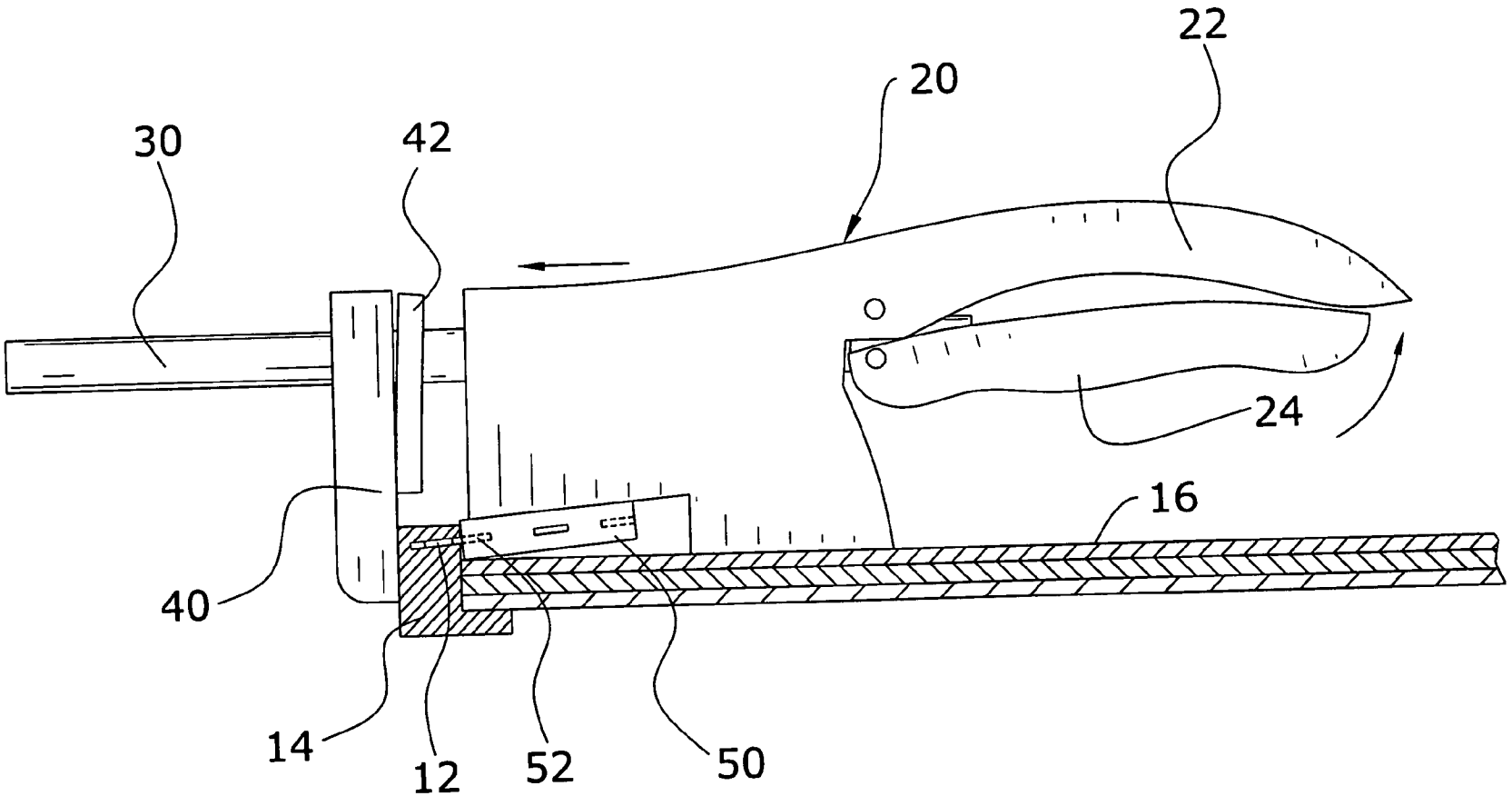
FIG. 6 is a side view of the present invention as initially positioned upon a picture frame with the framing point fully inserted into the frame.
Figure 7:
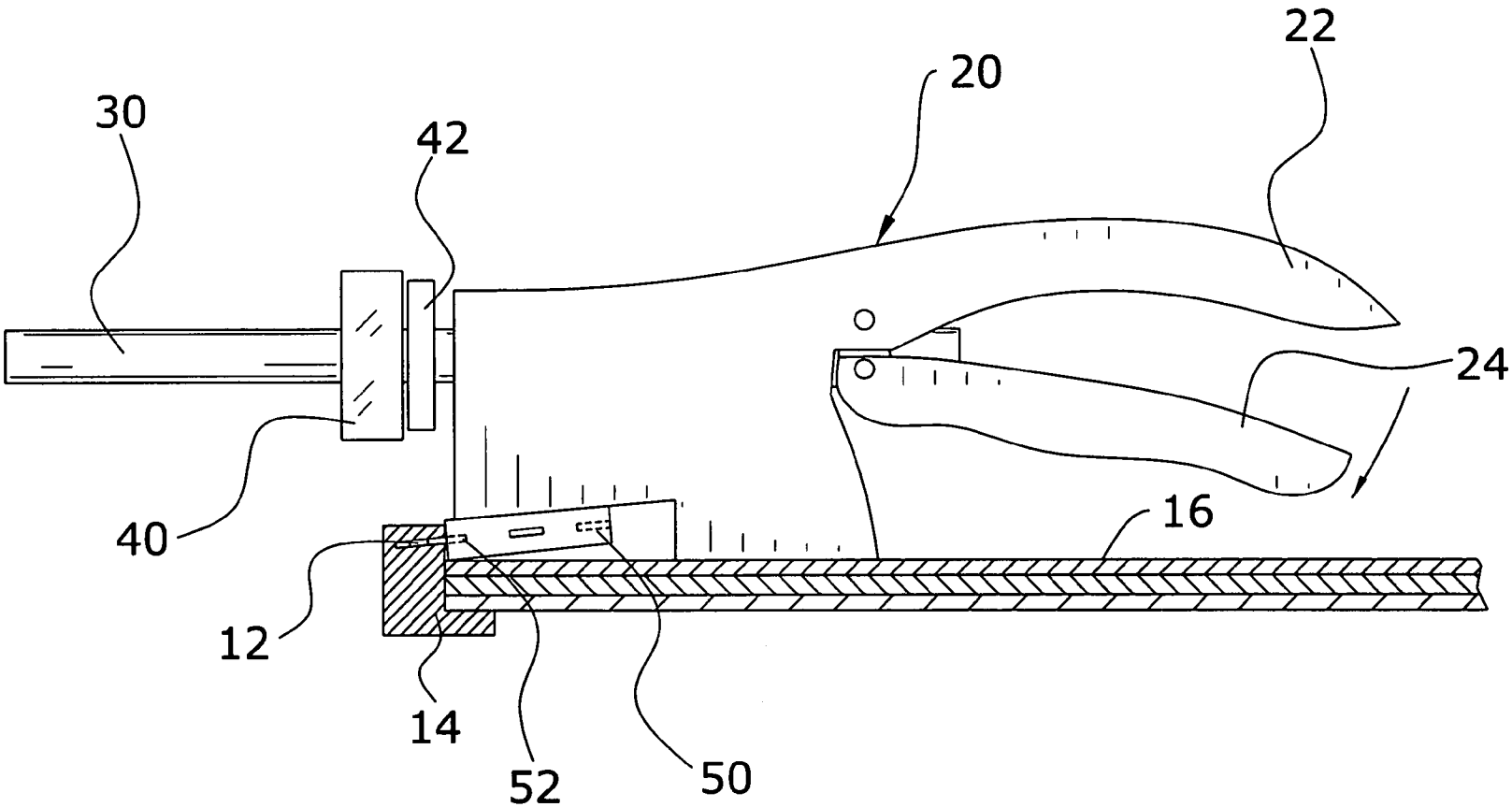
FIG. 7 is a side view of the present invention as initially positioned upon a picture frame with the framing point fully inserted into the frame with the engaging arm pivoted.

The turret member 50 preferably has a slight angle with respect to the backing 16 thereby inserting the framing point 12 at a downward angle as best illustrated in FIGS. 5 through 7 of the drawings. The angle may be between 0 to 45 degrees depending upon the application.

The receiver apertures 52 preferably each have a different size for receiving various sizes and shapes of framing points 12. The receiver apertures 52 are each preferably centrally positioned within a respective side of the turret member 50 as best shown in FIG. 4 of the drawings. The receiver apertures 52 each extend a finite distance into the turret member 50 depending upon the length of the framing point 12 that is desired to be exposed and extended from the picture frame 14. The end of each receiver aperture 52 is capable of engaging and forcing the framing point 12 forwardly into the picture frame 14.

The turret member 50 has a plurality of sides that receive the apertures as shown in FIGS. 1 through 4 of the drawings. Each of the sides of the turret member 50 preferably is comprised of a straight structure for providing a flush positioning against the inside edge of the picture frame 14 as shown in FIG. 5 of the drawings.

F. Operation

Figure 3:
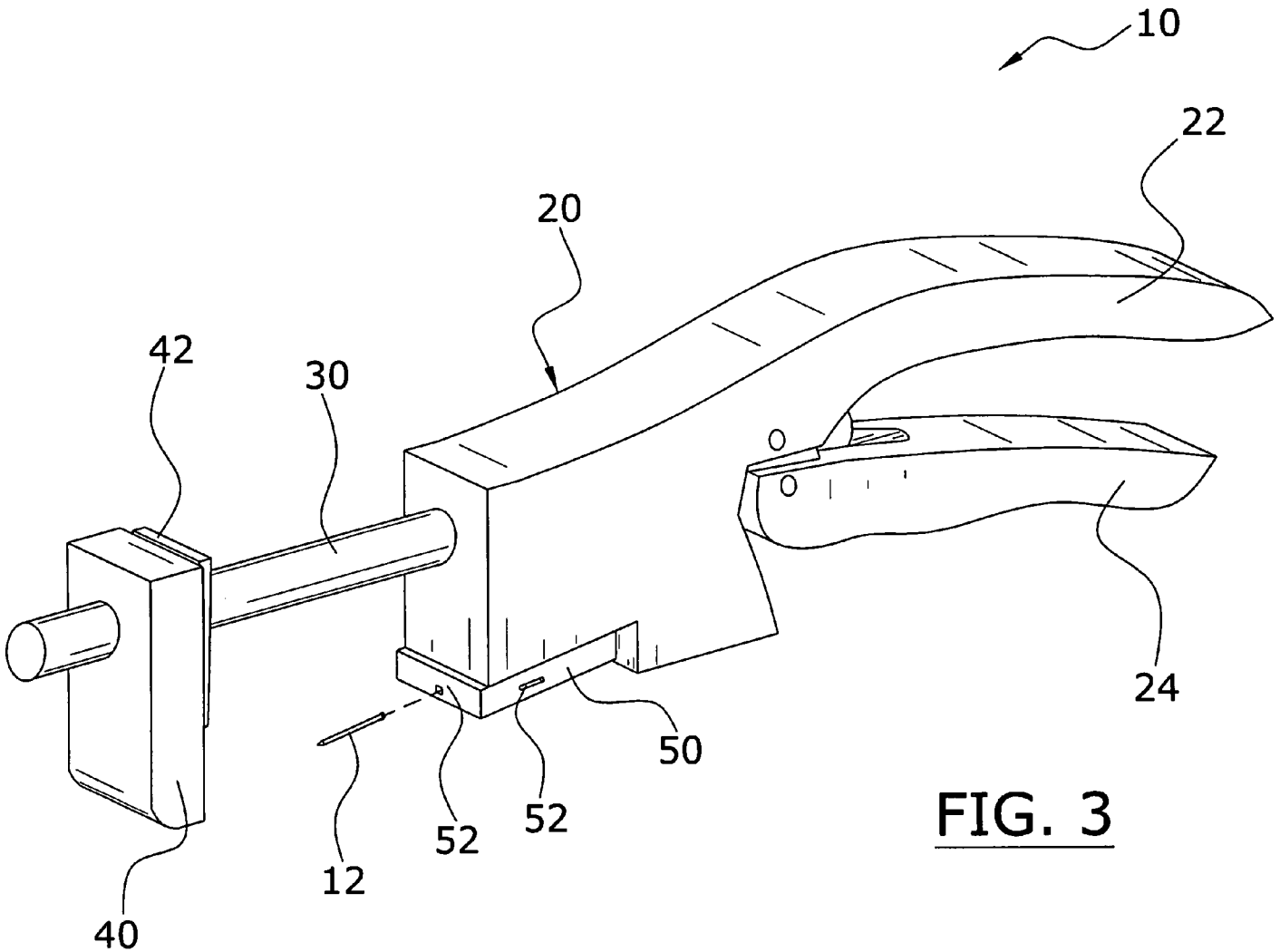
FIG. 3 is an upper perspective view of the present invention with a second style of framing point being inserted into the point turret.

In use, the user rotates the turret member 50 so the desired receiver aperture 52 is facing toward the engaging arm 40 as shown in FIGS. 1 through 3 of the drawings. The user then inserts the appropriate framing point 12 into the receiver aperture 52 as shown in FIG. 1 of the drawings.

The user then positions the framing point 12 driver system 10 with the turret member 50 adjacent to the backing 16 of the picture frame 14 with the framing point 12 adjacent to the inside edge of the picture frame 14. The user then moves the engaging arm 40 adjacent to the outside edge of the picture frame 14 as shown in FIG. 5 of the drawings. The user then manipulates the lever member 24 thereby drawing the turret member 50 forwardly which inserts the framing point 12 into the picture frame 14 as further shown in FIG. 5. This framing point 12 is fully inserted into the picture frame 14 when the face of the turret member 50 is adjacent to the picture frame 14 as shown in FIG. 6 of the drawings.

Figure 8:
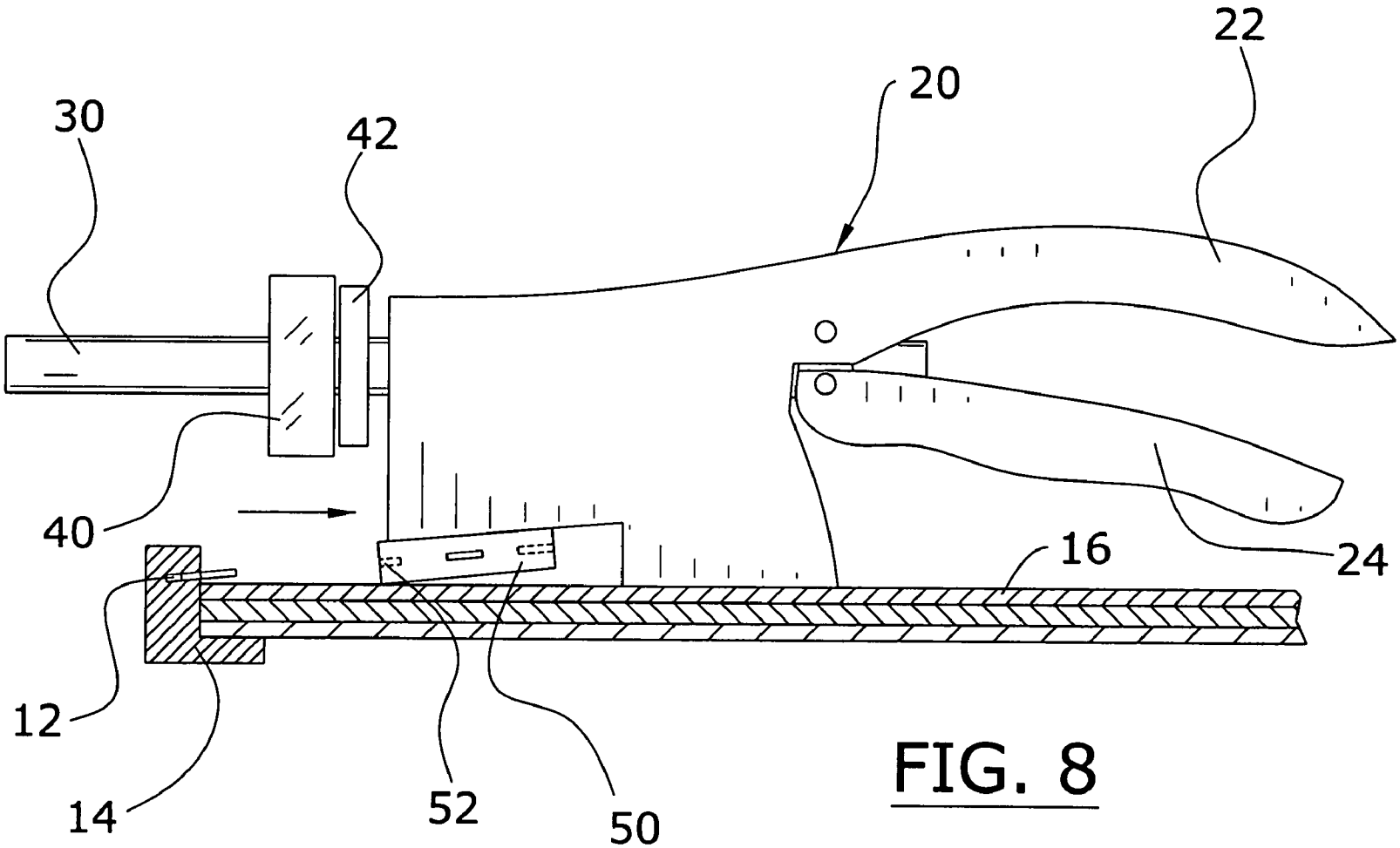
FIG. 8 is a side view of the present invention being removed from the fully inserted framing point.

After the framing point 12 is fully inserted into the picture frame 14, the user then releases the lever member 24 and then rotates the engaging arm 40 as shown in FIG. 7 of the drawings. The user then pulls the lever unit 20 rearwardly from the inserted framing point 12 as shown in FIG. 8 of the drawings. The process continues until the backing 16 is fully secured to the picture frame 14.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A framing point driver system, comprising:

a lever unit;

a shaft member movably extending in a longitudinal manner from said lever unit;

an engaging arm lockably positioned about said shaft member; and a turret member with a plurality of receiver apertures rotatably attached to said lever unit, wherein said receiver apertures removably receive a framing point, and wherein said turret member is rotated in such a way that a desired receiver aperture is facing toward the engaging arm.

2. The framing point driver system of claim 1, wherein said receiver apertures each receive different sizes of receiver points.

3. The framing point driver system of claim 1, wherein said receiver apertures each have a different size.

4. The framing point driver system of claim 1, wherein said receiver apertures are each centrally positioned within a respective side of said turret member.

5. The framing point driver system of claim 1, wherein said turret member has a plurality of sides that receive said apertures.

6. The framing point driver system of claim 5, wherein each of said sides is comprised of a straight structure.

7. The framing point driver system of claim 6, wherein said turret member has a rectangular shape.

8. The framing point driver system of claim 6, wherein said turret member has a square shape.

9. The framing point driver system of claim 6, wherein said turret member has a polygonal shape.

10. The framing point driver system of claim 1, wherein said engaging arm includes a locking member for selecting locking upon said shaft member.

11. A framing point driver system, comprising:

a lever unit;

a shaft member movably extending in a longitudinal manner from said lever unit;

an engaging arm lockably positioned about said shaft member; and a turret member with a plurality of receiver apertures rotatably attached to said lever unit, wherein said receiver apertures removably receive a framing point and wherein said turret member has a rotational plane transverse with respect to said engaging arm in such a way that a desired receiver aperture is facing toward the engaging arm.

12. The framing point driver system of claim 11, wherein said receiver apertures each receive different sizes of receiver points.

13. The framing point driver system of claim 11, wherein said receiver apertures each have a different size.

14. The framing point driver system of claim 11, wherein said receiver apertures are each centrally positioned within a respective side of said turret member.

15. The framing point driver system of claim 11, wherein said turret member has a plurality of sides that receive said apertures.

16. The framing point driver system of claim 15, wherein each of said sides is comprised of a straight structure.

17. The framing point driver system of claim 16, wherein said turret member has a rectangular shape.

18. The framing point driver system of claim 16, wherein said turret member has a square shape.

19. The framing point driver system of claim 16, wherein said turret member has a polygonal shape.

20. The framing point driver system of claim 11, wherein said engaging arm includes a locking member for selecting locking upon said shaft member.

* * * * *